US008336246B1

(12) United States Patent
Barber

(10) Patent No.: US 8,336,246 B1
(45) Date of Patent: Dec. 25, 2012

(54) RAIL ATTACHMENT MECHANISM

(76) Inventor: Ross F. Barber, Manchester, NH (US)

( * ) Notice: Subject to any disclaimer, the term of this patent is extended or adjusted under 35 U.S.C. 154(b) by 142 days.

(21) Appl. No.: 12/831,513

(22) Filed: Jul. 7, 2010

Related U.S. Application Data

(60) Provisional application No. 61/224,244, filed on Jul. 9, 2009.

(51) Int. Cl.
*F41G 1/387* (2006.01)

(52) U.S. Cl. ..... 42/127; 42/124

(58) Field of Classification Search ..... 42/124, 42/127, 128, 126, 125
See application file for complete search history.

(56) References Cited

U.S. PATENT DOCUMENTS

| | | | | |
|---|---|---|---|---|
| 4,501,071 | A * | 2/1985 | Manske | 42/127 |
| 6,922,934 | B1 * | 8/2005 | Huan | 42/127 |
| 7,107,716 | B1 * | 9/2006 | Liao | 42/108 |
| 7,735,255 | B1 * | 6/2010 | Kincaid et al. | 42/146 |
| 7,757,423 | B1 * | 7/2010 | Swan | 42/127 |
| 7,905,045 | B1 * | 3/2011 | Swan | 42/127 |

* cited by examiner

*Primary Examiner* — Stephen M Johnson

(57) ABSTRACT

A rail mounting mechanism for coupling an auxiliary device to a weapon has a cam and a jaw and rotation of the cam causes the jaw to come into contact with a surface of a mounting rail to squeeze the rail in a direction perpendicular to a longitudinal axis of rotation of the cam.

12 Claims, 11 Drawing Sheets

RAIL ATTACHMENT MECHANISM

CROSS REFERENCE TO RELATED APPLICATIONS

The present application claims the benefit of U.S. provisional patent application Ser. No. 61/224,244 filed Jul. 9, 2009, the entire disclosure of which is incorporated herein by reference.

BACKGROUND

The need to effectively see a target and aim a weapon in the direction of the target is well recognized. Auxiliary devices to facilitate illuminating or marking a target or aiming a weapon include, but are not limited to, sights, scopes, laser illuminators, laser pointers, flashlights, combined laser illuminator/pointer devices, and night vision and infrared imagers. These auxiliary devices are often mounted to weapons having rail mounting systems with a certain profile, for example a rail profile consistent with MIL-STD-1913. These auxiliary devices may be mounted on the top, bottom, or one of the sides of a four-sided section of rail. Often two or more auxiliary devices may be mounted on a section of rail with one of the auxiliary devices blocking access to the mounting mechanism of another auxiliary device. This may require the operator to remove one device in order to remove or adjust another device. This extra step is time consuming and may require the operator to have to realign the device to zero or bore sight a weapon. Some auxiliary devices have a mounting mechanism with a handle that rotates in a plane parallel with the bore of the weapon. These mechanisms often have a cammed surface that rubs against the rail as the handle is rotated, and can mar the rail surface.

BRIEF DESCRIPTION OF THE DRAWINGS

For a better understanding of the present invention, together with other objects, features and advantages, reference should be made to the following detailed description, which should be read in conjunction with the following figures wherein.

DETAILED DESCRIPTION OF THE EMBODIMENTS

Figure 1:
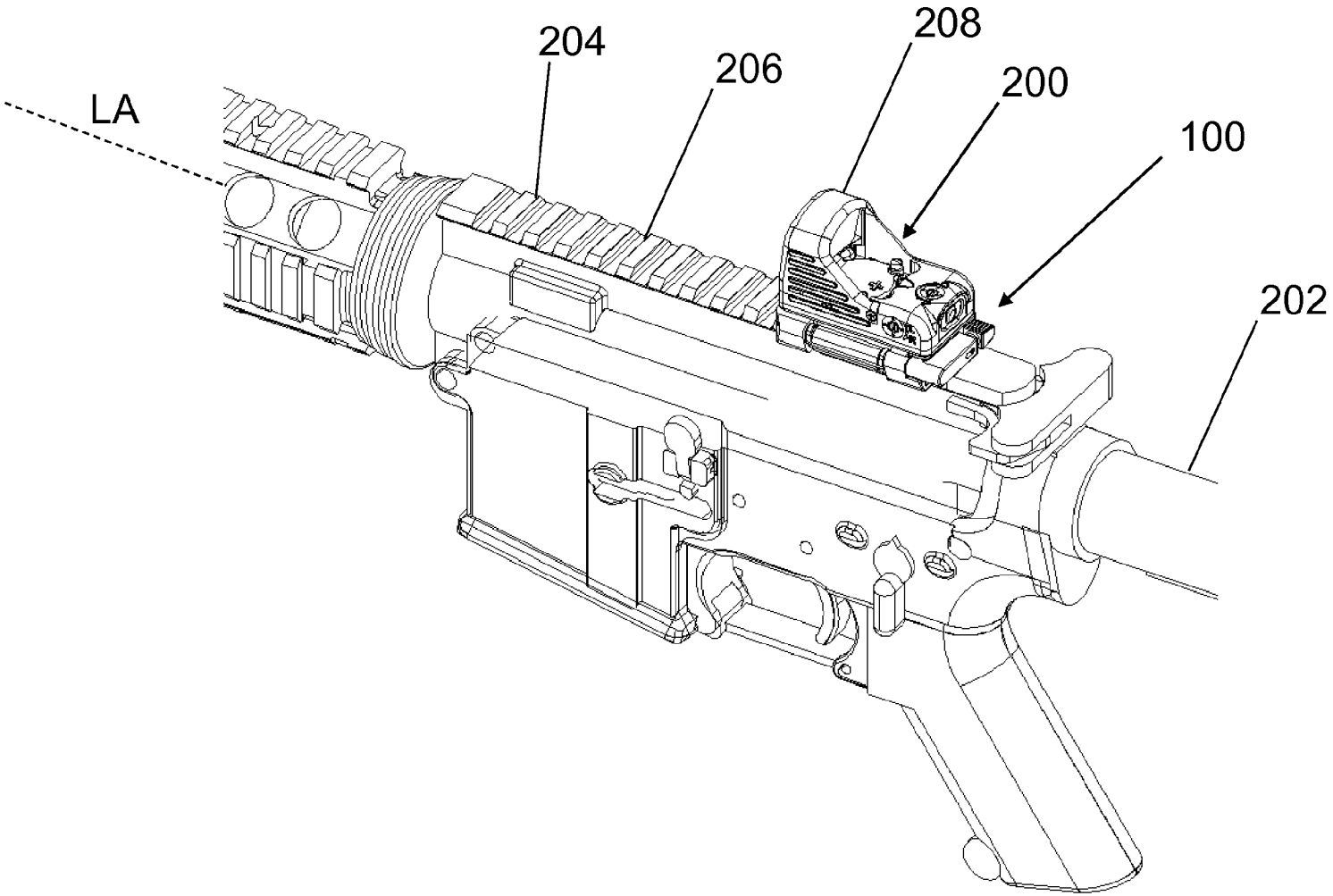
FIG. 1 is an isometric view of an auxiliary device mounted to a weapon with a first mounting mechanism consistent with a first embodiment of the invention.

FIG. 1 is an isometric view of an auxiliary device 200 mounted to a weapon 202 with a first mounting mechanism 100 consistent with a first embodiment of the invention. Auxiliary devices include, but are not limited to sights, scopes, laser illuminators, laser pointers, flashlights, and combined laser illuminator/pointer devices, and night vision and infrared imagers. The auxiliary device 200 may have a housing 208 for enclosing optics and electronics. The mounting mechanism 100 may be removably coupled to the auxiliary device 200 or may be formed as an integral part of an auxiliary device. Auxiliary device 200 may be secured to one of the rails 204 on the weapon 202 and be aligned parallel with a longitudinal axis LA of the weapon 202. The auxiliary device 200 may be secured to a rail disposed above, below, or on the side of the weapon, depending on its intended purpose. The rail may have a MIL-STD-1913, Weaver, or other profile and may include one or more cross slots 206 that may be used to resist movement of the auxiliary device 200 along the longitudinal axis LA of the weapon during recoil.

Figure 2B:
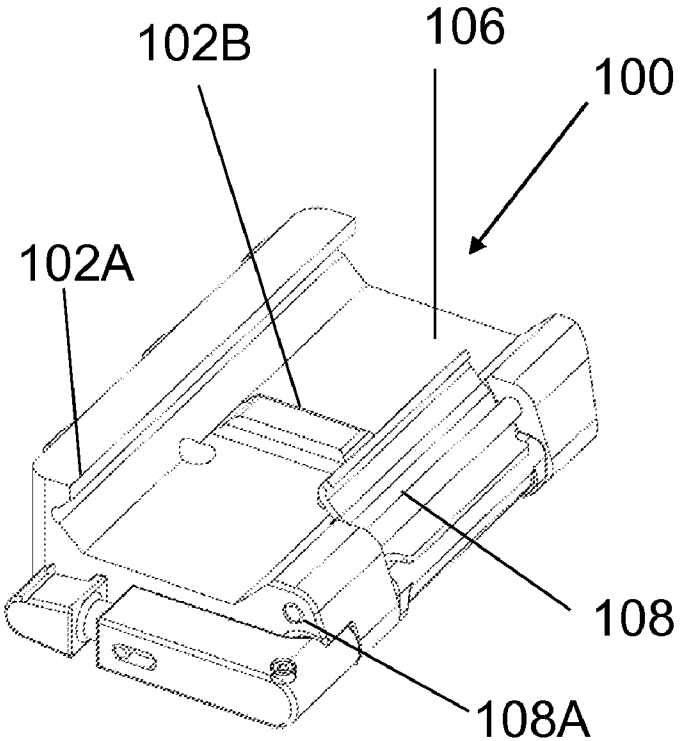
FIG. 2B is a bottom isometric view of the mounting mechanism of FIG. 1.
Figure 2A:
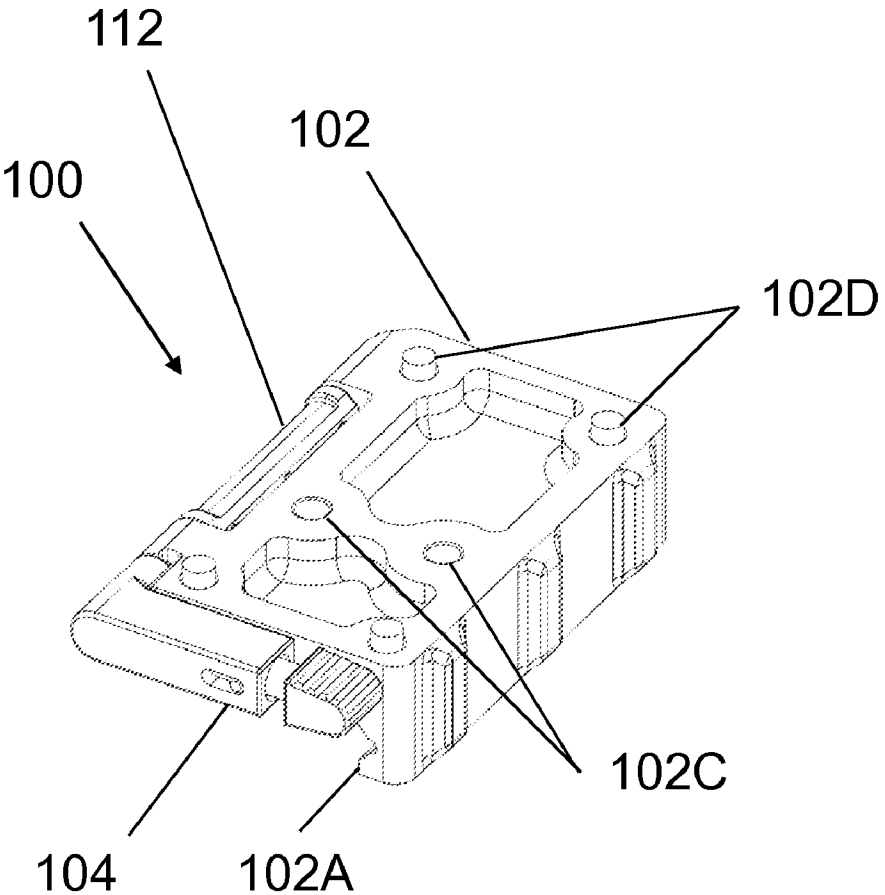
FIG. 2A is a top isometric view of the mounting mechanism of FIG. 1.
Figure 2C:
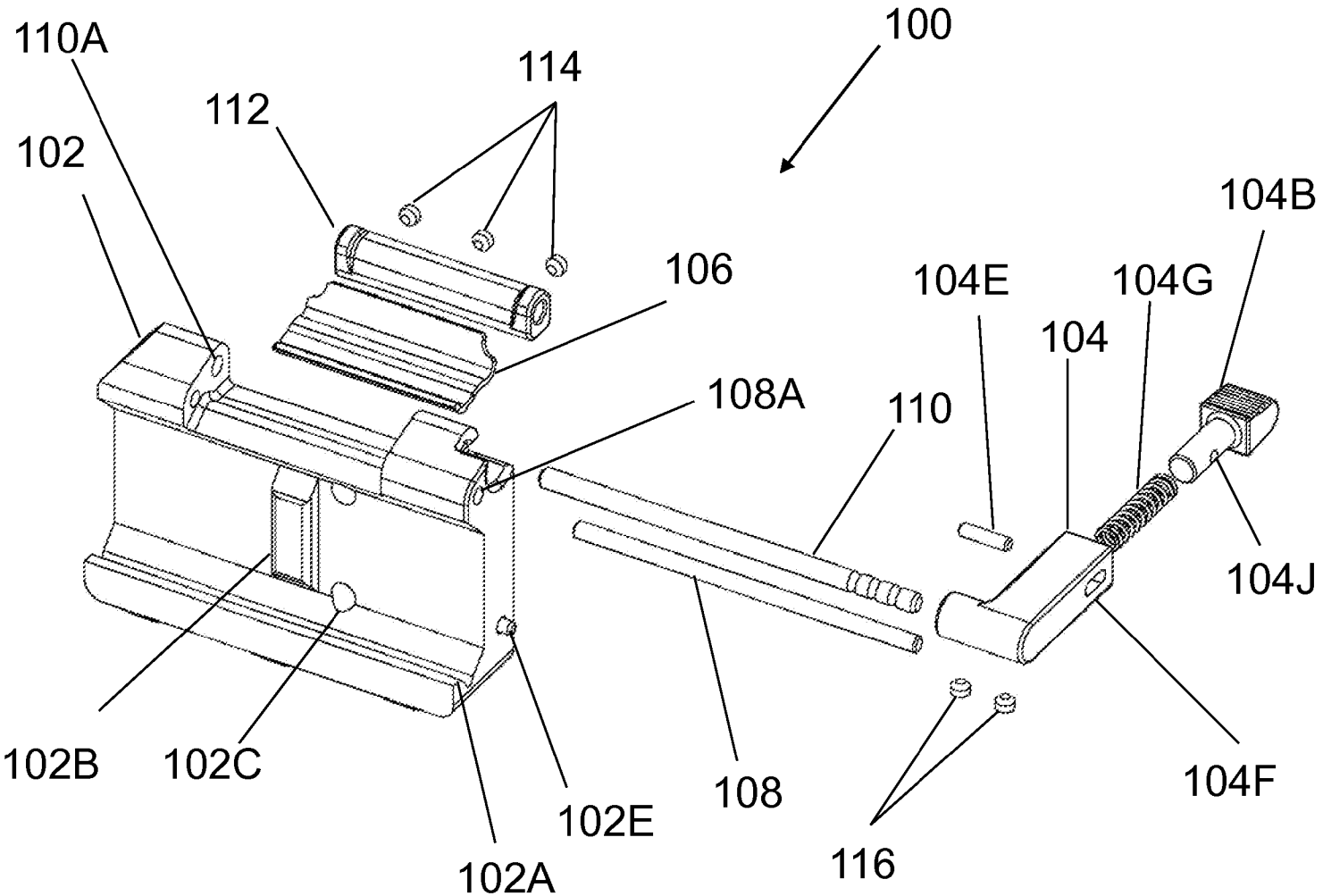
FIG. 2C is an exploded isometric view of the mounting mechanism of FIG. 1.

FIG. 2A is a top isometric view, FIG. 2B is a bottom isometric view, and FIG. 2C is an exploded isometric view of the mounting mechanism 100. Mounting mechanism 100 may have a structure 102, a handle 104, a jaw 106, a pivot pin 108, a cam shaft 110, a cam 112, and fasteners 114, 116. The structure 102 may have an elongated member 102A that cooperates with the rail profile to secure the mounting mechanism 100 to the weapon 202 and one or more cross bar(s) 102B may cooperate with a cross slot 206 in the rail 204 to resist movement of the auxiliary device along the longitudinal axis LA of the weapon 202 during firing. The cross bar 102B may be fixed or movable relative to the structure 102. Pivot pin 108 may be press fit into a cooperating opening 108A in the structure 102 to resist removal and cam shaft 110 may be inserted into a cooperating opening 110A in the structure 102 to allow rotation. The structure 102 may have one or more openings 102C for fasteners to extend into or through for securing the mounting mechanism 100 to the auxiliary device 200. The structure 102 may also have one or more alignment pins 102D that cooperate with openings 202 in the auxiliary device 200. Alternatively, the mounting mechanism may be integrally formed as part of an auxiliary device. Fasteners 114 may be used to prevent rotation of the cam 112 relative to the cam shaft 110 and fasteners 116 may be used to prevent rotation of the cam shaft 110 relative to the handle 104. Alternatively, the shaft geometry may be changed or adhesive may be used to prevent rotation of the cam shaft 110 relative to the cam 112 and the handle 104. The handle 104 may have a movable portion 104B slidably coupled to the handle 104. The movable portion 104B may be inserted in an opening in the handle 104 and retained by a pin 104E inserted into an opening 104F in the handle 104 and an opening 104J in the movable portion 104B and biased in one direction with a spring 104G. The movable portion 104B may have a feature 104H, for example a slot (see FIGS. 7A-C), that cooperates with a feature 102E, for example a pin, on the structure 102 to prevent rotation of the handle from a "locked" position without the movable portion 104B being moved.

Figure 3B:
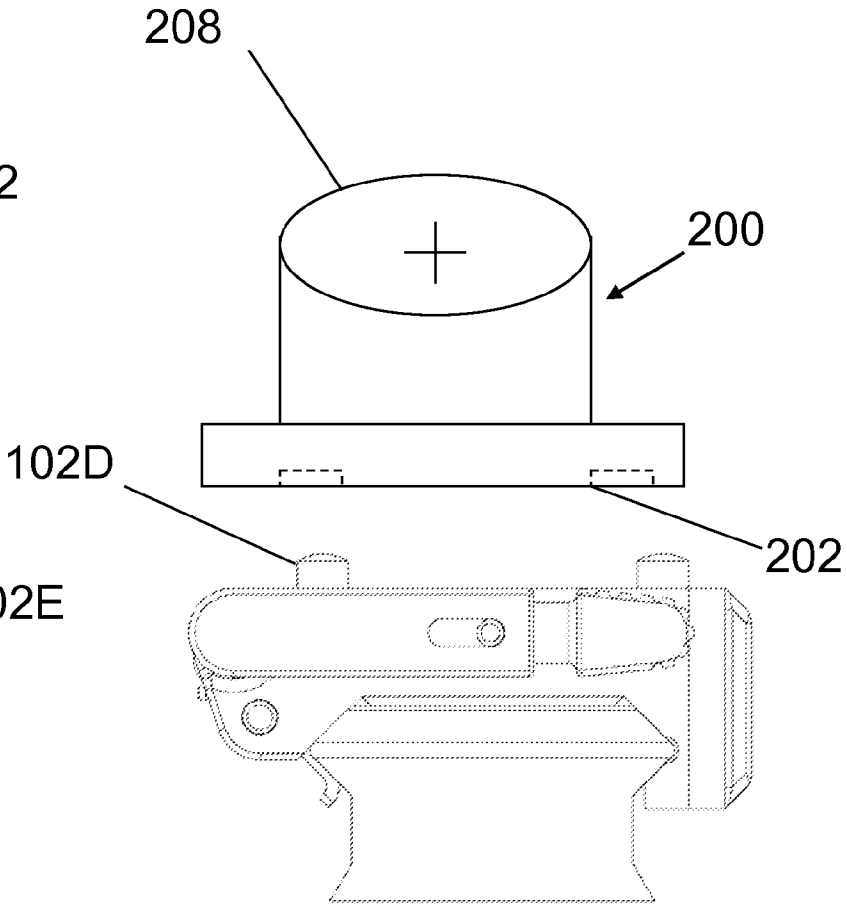
FIG. 3B is an end view of the mounting mechanism of FIG. 1 secured to the section of rail with the mounting mechanism in a "locked" position.
Figure 3A:
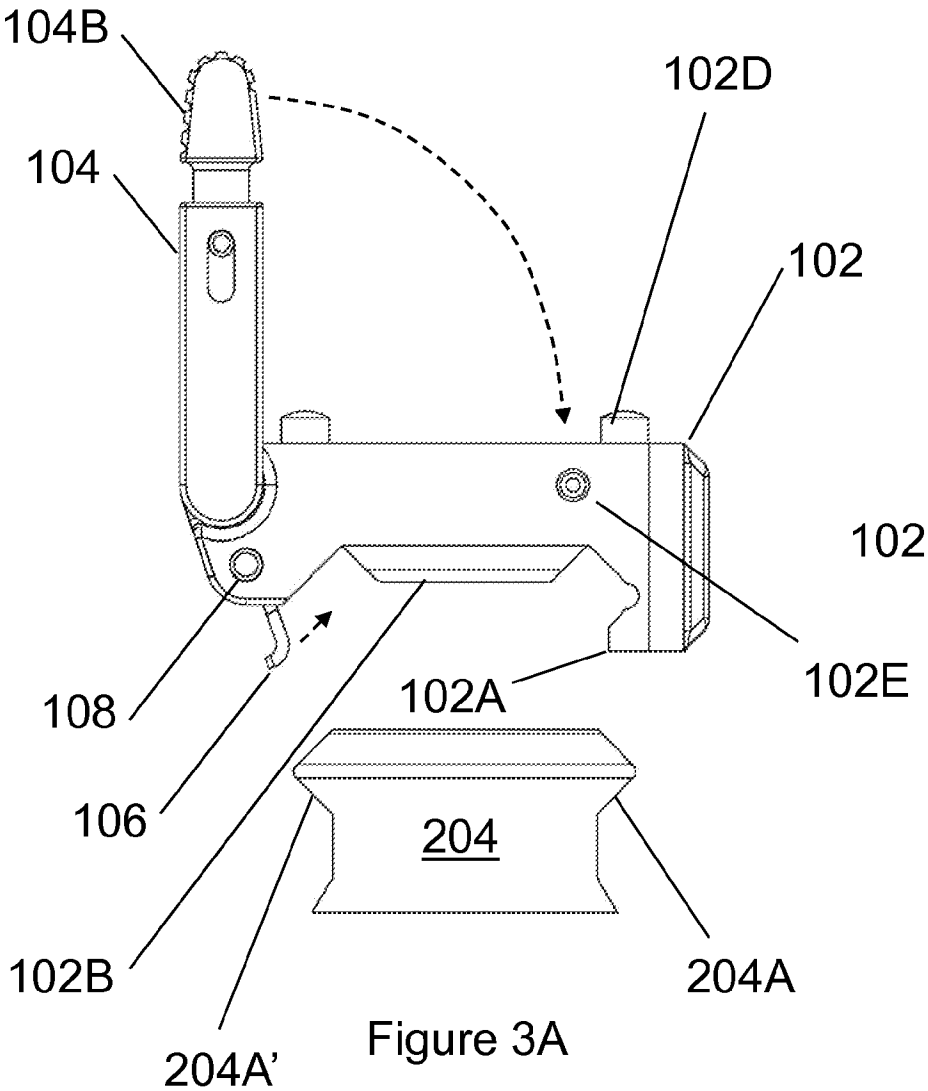
FIG. 3A is an end view of the mounting mechanism of FIG. 1 spaced from a section of rail with the mounting mechanism in an "unlocked" position.
Figure 4:
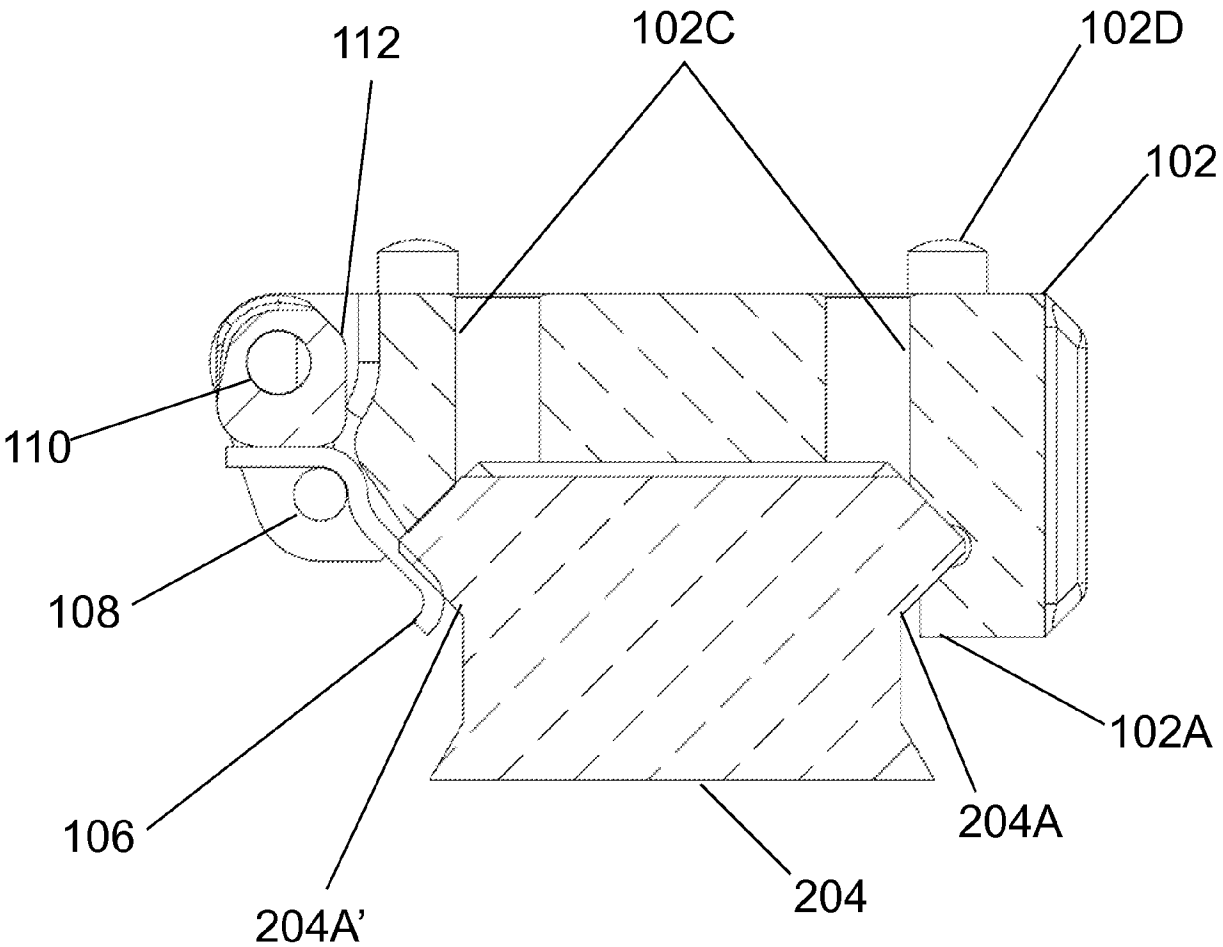
FIG. 4 is an end section view of the mounting mechanism of FIG. 1 secured to the section of rail with the mounting mechanism in a "locked" position.

FIG. 3A is an end view of the mounting mechanism 100 spaced from a section of rail 204 with the mounting mechanism 100 in an "unlocked" position and FIG. 3B is an end view and FIG. 4 is an end section view of the mounting mechanism 100 mounted to the section of rail 204 with the mounting mechanism 100 in a "locked" position. With the cross bar 102B aligned with a cross slot 206 on the rail 204, the elongated member 102A on the mounting mechanism 100 may be hooked under a lower portion 204A of the profile of the rail 204 and the mounting mechanism 100 may then be rotated (counterclockwise shown) until the bottom surface of the structure 102 contacts the upper surface of the rail 204. If the mounting mechanism has a movable cross bar, the mounting mechanism could be slid into place instead of rotated into place. The handle 104 may be rotated (clockwise shown) from the "unlocked" to the "locked" position to secure the mounting mechanism 100 (and auxiliary device 200) to the rail 204. A boss 104D (see FIG. 7A) on the handle 104 may interfere with one or more features on the structure 102 to prevent over rotation. Rotation of the handle 104 causes cam 112 to rotate which causes jaw 106 to rotate about pivot pin 108 and come into contact with a lower portion 204A' of the profile of the rail 204.

Figure 5A:
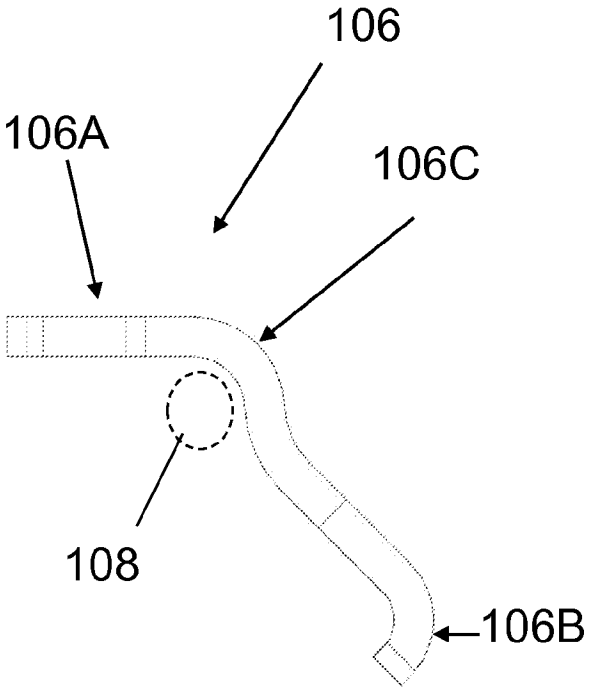
FIG. 5A is an end view of a first jaw consistent with a first embodiment of the invention.
Figure 5B:
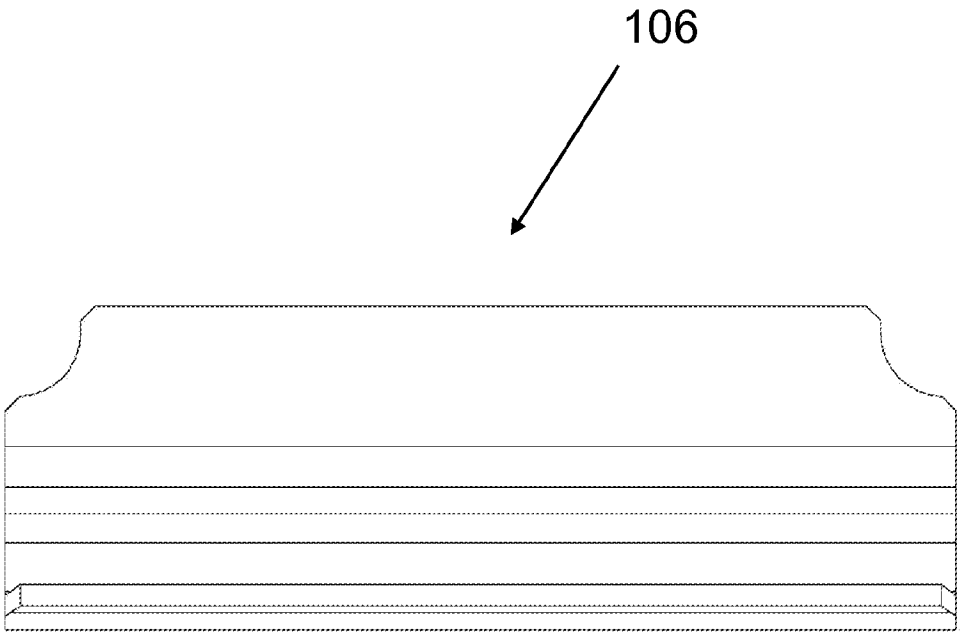
FIG. 5B is a side view of the jaw of FIG. 5A.

FIG. 5A is an end view and FIG. 5B is a side view of the first jaw 106 consistent with a first embodiment of the invention. The jaw 106 may be formed from a suitable material, for example beryllium copper or spring steel. The jaw material, thickness, heat treating, and configuration may be varied to meet a desired clamping force on the rail 204 or a desired torque on the handle 104 without departing from the invention. The jaw 106 may have a first portion 106A that rides against the cam 112, a second portion 106B that presses against the lower portion 204A' of the rail, and a pivot portion 106C that pivots about the pivot pin 108. The jaw 106 may rotate between an "unlocked" position in which the mounting mechanism 100 may be released from the rail 204 and a "locked" position in which the first mounting mechanism 100 is secured to the rail.

Figure 6B:
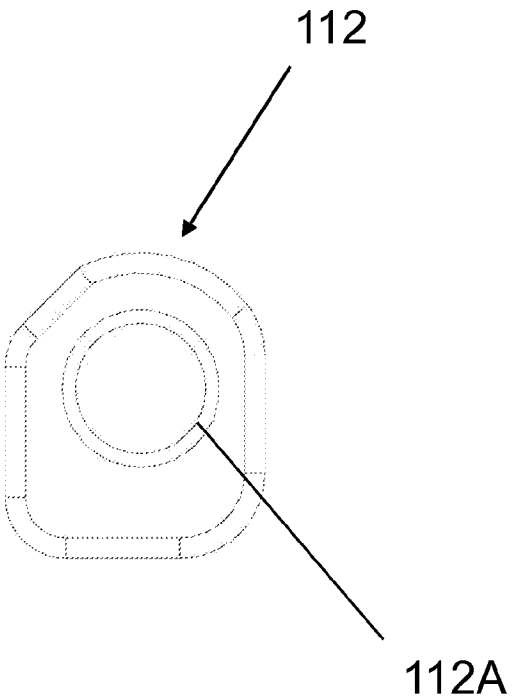
FIG. 6B is an end view of the cam of FIG. 6A.
Figure 6A:
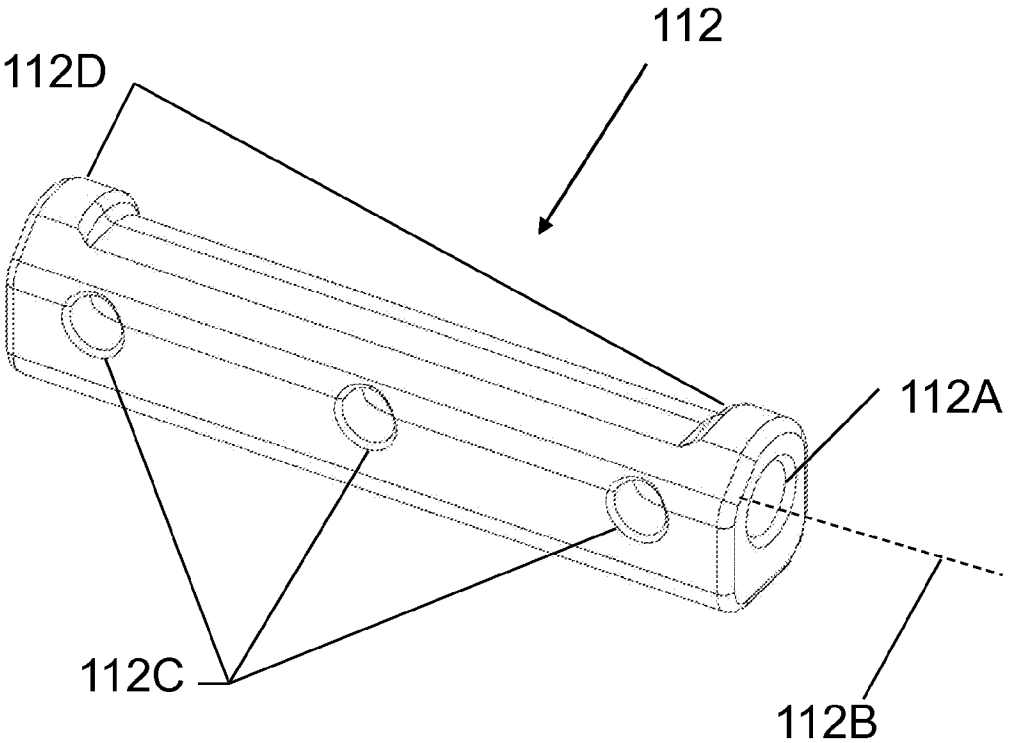
FIG. 6A is an isometric view of a first cam consistent with a first embodiment of the invention.

FIG. 6A is an isometric view and FIG. 6B is an end view of the first cam 112 consistent with a first embodiment of the invention. The cam 112 may have a longitudinal opening 112A, with a longitudinal axis 112B sized to allow the cam shaft 110 to fit into, and one or more openings 112C to prevent motion of the cam shaft 110 relative to the cam 112. The cam 112 may include enlarged portions 112D to stiffen the cam 112. The cam 112 may have an over-center profile that may be varied to meet a desired clamping force on the rail 204 or a desired torque on the handle 104 without departing from the invention.

Figure 7A:
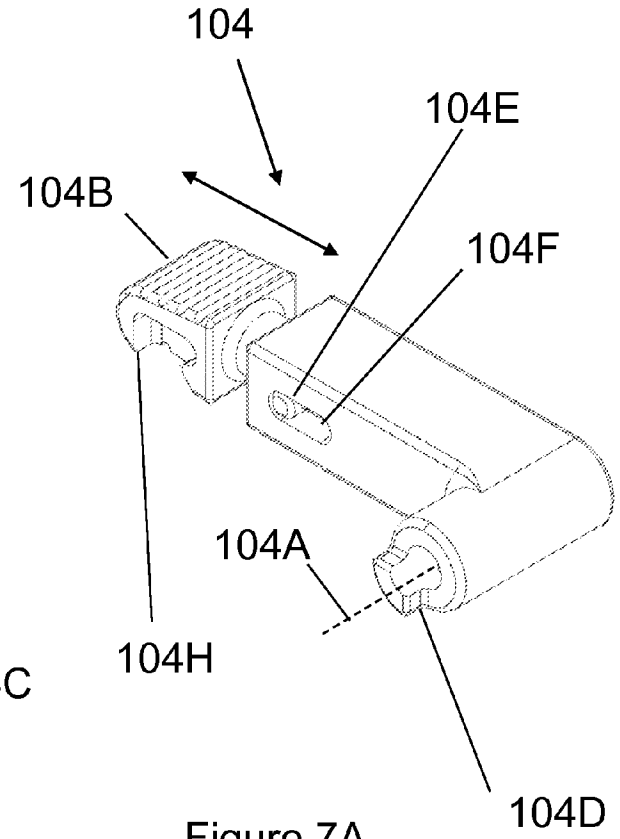
FIG. 7A is an isometric view of a first handle consistent with a first embodiment of the invention.
Figure 7B:
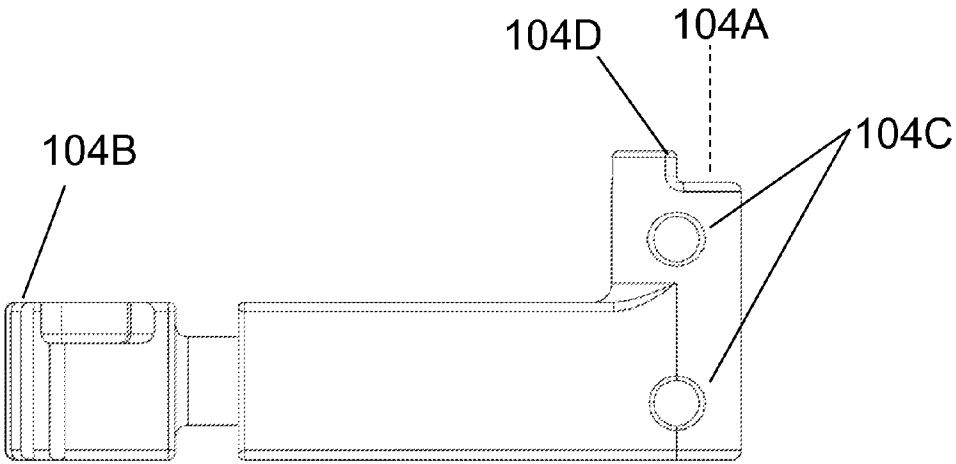
FIG. 7B is a top view of the handle of FIG. 7A.
Figure 7C:
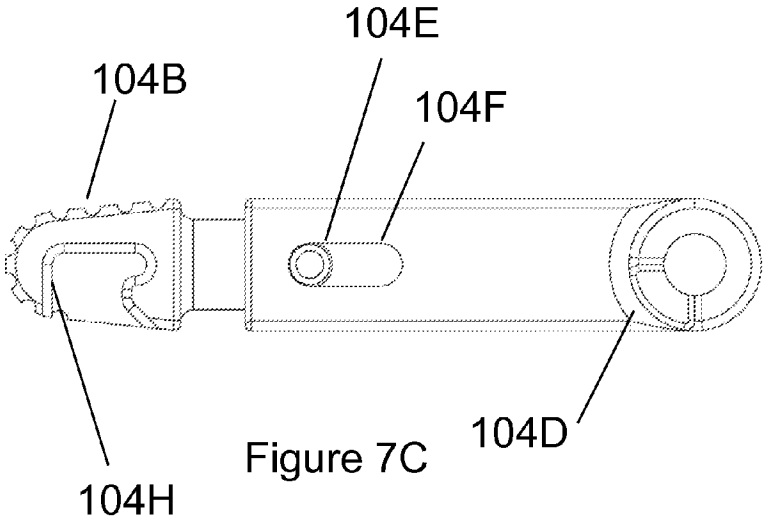
FIG. 7C is a rear view of the handle of FIG. 7A.

FIG. 7A is an isometric view, FIG. 7B is a top view, and FIG. 7C is a rear view of the first handle 104 consistent with a first embodiment of the invention. The handle 104 may have an opening 104A that the cam shaft 110 fits into. Rotation of the handle 104 causes the cam 112 to rotate. The one or more fasteners 116 may extend into through openings 104C in the handle 104 and come into contact with a flat 110A (see FIG. 8A) or other feature on the cam shaft 110 to prevent rotation of the handle 104 relative to the cam shaft 110.

Figure 8B:
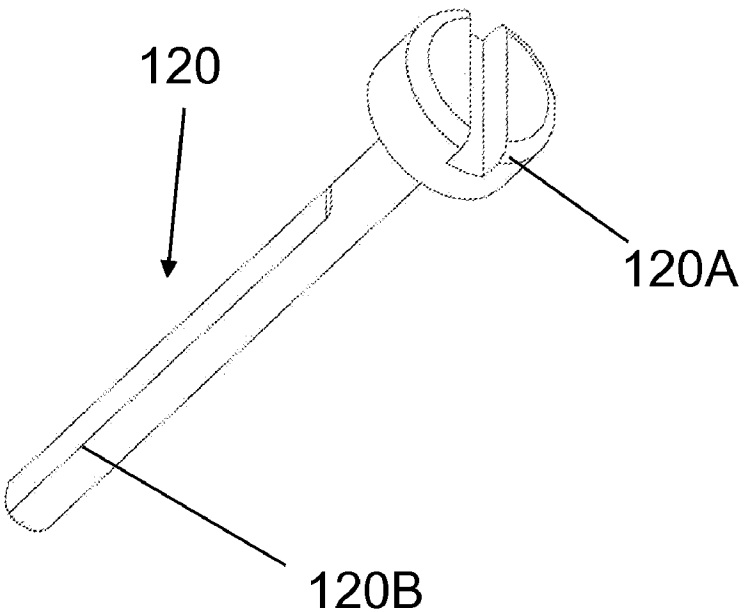
FIG. 8B is an isometric view of a second cam shaft consistent with a second embodiment of the invention.
Figure 8A:
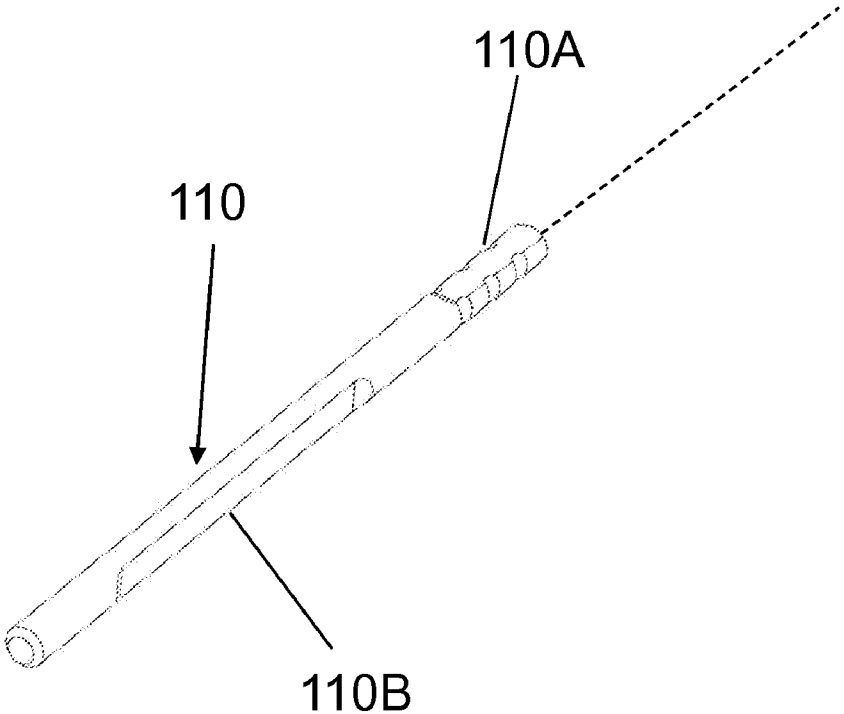
FIG. 8A is an isometric view of a first cam shaft consistent with a first embodiment of the invention.

FIG. 8A is an isometric view of a first cam shaft 110 consistent with a first embodiment of the invention. The cam shaft 110 may have a first flat or other feature 110A that the fasteners 116 come into contact with to prevent rotation of the handle 104 relative to the cam shaft 110. The cam shaft 110 may have a second flat or other feature 110B that the fasteners 114 come into contact with to prevent rotation of the cam 112 relative to the cam shaft 110.

FIG. 8B is an isometric view of a second cam shaft 120 consistent with a second embodiment of the invention. The cam shaft 120 may have a head 120A at one end that cooperates with a screw driver or other tool to cause rotation and a flat or other feature 120B that the fasteners 114 come into contact with to prevent rotation of the cam 112 relative to the cam shaft 120.

Figure 9:
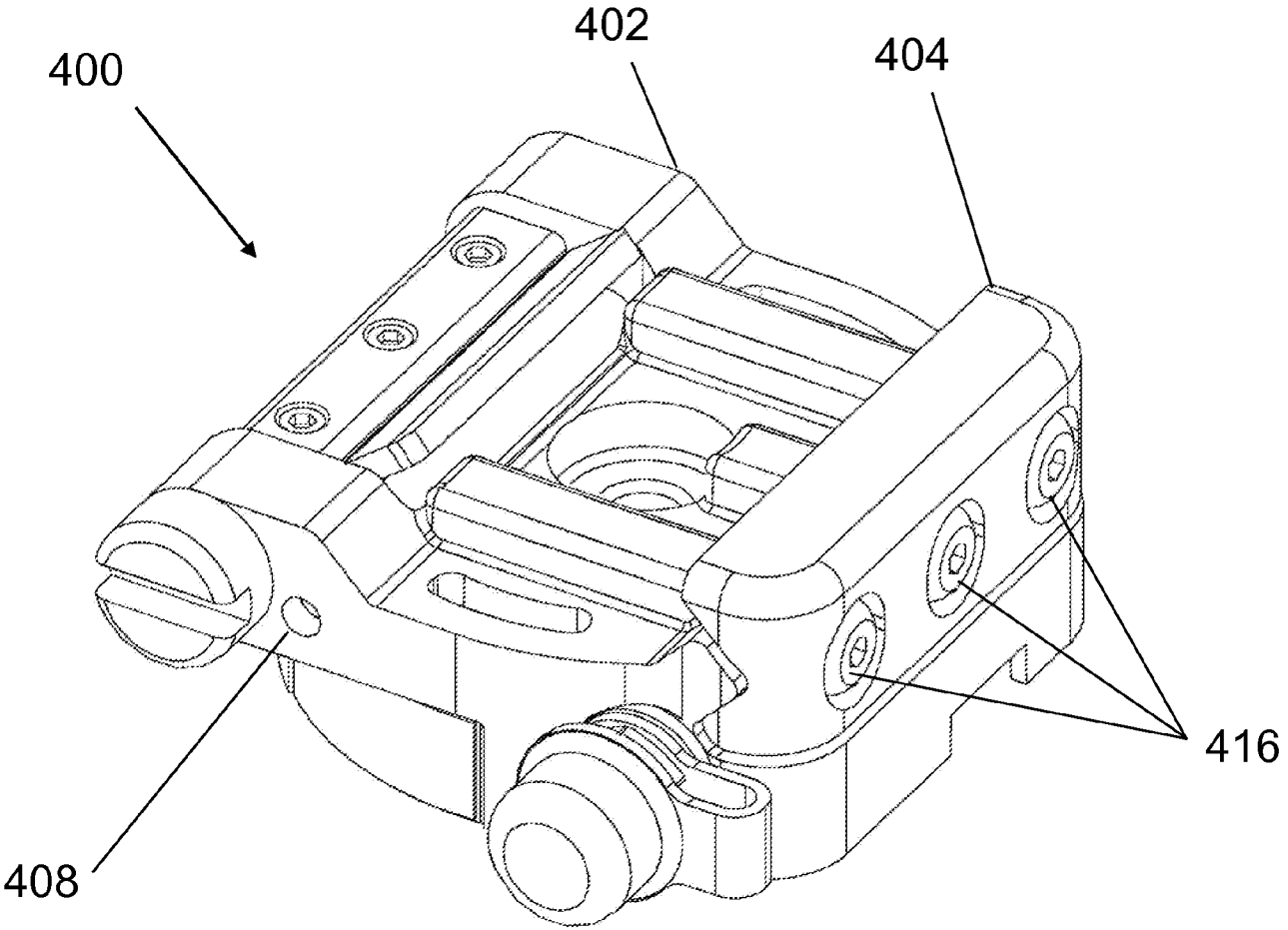
FIG. 9 is an isometric view of a second mounting mechanism consistent with a second embodiment of the invention.
Figure 10:
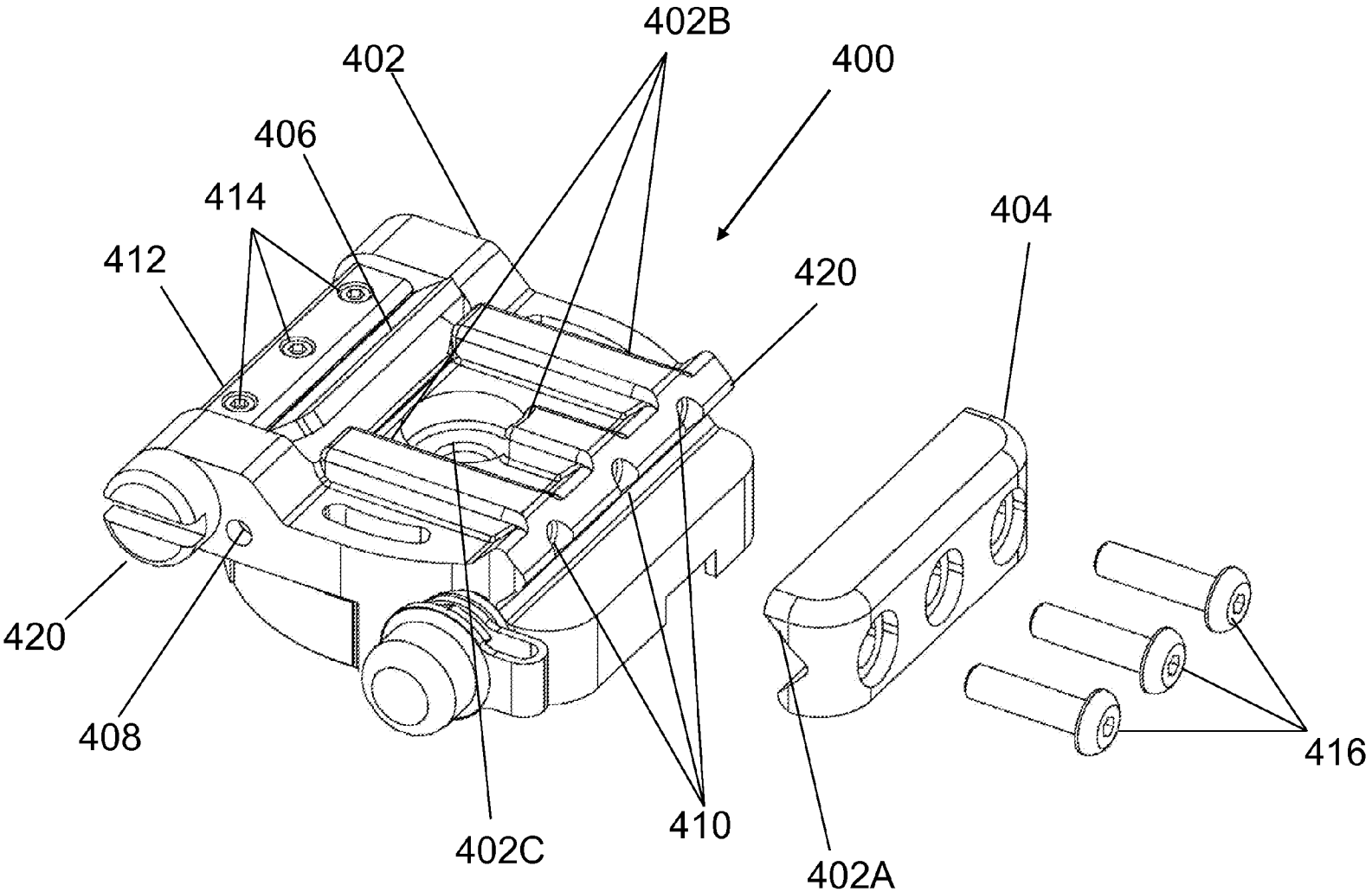
FIG. 10 is an exploded isometric view of the mounting mechanism of FIG. 9.

FIG. 9 is an isometric view and FIG. 10 is an exploded isometric view of a second mounting mechanism 400 consistent with a second embodiment of the invention. The mounting mechanism 400 may be similar to the mounting mechanism 100, with the addition of an adjustment jaw. Mounting mechanism 400 may have a structure 402, a jaw 406, an adjustment jaw 404, a pivot pin 408, a cam shaft 420, a cam 412, and fasteners 114 and 416. The structure 402 may have one or more cross bar(s) 402B that may be used to resist movement of the mount along the longitudinal axis of a weapon during firing. The cross bar may be fixed or movable relative to the structure 102. Pivot pin 408 may be press fit into a cooperating opening in the structure 402 to resist removal and cam shaft 420 may be inserted into a cooperating opening in the structure 402 to allow rotation. The structure 402 may have one or more openings 402C for fasteners to extend into or through for securing the mounting mechanism 400 to an auxiliary device. The structure 402 may also have one or more alignment pins (not shown) that cooperate with openings in an auxiliary device. Alternatively, the mounting mechanism may be integrally formed as part of an auxiliary device. Fasteners 114 may be used to prevent rotation of the cam shaft 420 relative to the cam 412. Alternatively, the shaft geometry may be changed or adhesive may be used to prevent rotation of the cam shaft 420 relative to the cam 412. Alternatively, the cam shaft 420 may be replaced with a handle like the one shown in FIG. 2A.

The one or more fasteners 416 may extend into threaded openings 410 in the structure 402 to allow for adjustment of the distance between the axis of the pivot pin 408 and the adjustment jaw 404. Rotation of the fasteners 416 may cause the adjustment jaw 404 towards or away from the axis of the pivot pin 408. The adjustment may be made in the factory during assembly and then the fasteners may be prevented from rotation, for example with an adhesive, or the adjustment may be made in the field by the end user. Jaw 404 may have an elongated member 402A that cooperates with a feature 420 of the structure 402 and a rail to secure the mounting mechanism 400 to a rail of weapon.

According to one embodiment, a rail attachment mechanism includes structure with a cam rotatable secured thereto and a jaw rotatable about a pin secured to the structure, rotation of the cam causing the jaw to come into contact with a surface of rail to squeeze the rail in a direction perpendicular to the axis of rotation of the cam.

This invention has been described in connection with various embodiments. These embodiments are for example only and are not intended to limit the invention. Various changes and modifications may be made to the embodiments without departing from the scope of the invention as defined by the appended claims. The invention encompasses all devices and equivalents which are within the scope of the claims which follow.

What is claimed is:

1. A rail attachment mechanism for securing an auxiliary device to a rail of a weapon, comprising:

a mounting structure;

a cam secured to the structure and rotatable about a first axis of rotation; and a jaw rotatable about a pin secured to the structure, the pin having a second axis parallel to the first axis, the cam being in contact with a first end of the jaw and rotation of the cam causing a second end of the jaw to come into contact with a surface of a rail of a weapon to squeeze the rail in a direction perpendicular to the first axis of rotation of the cam, the pin being disposed between the first end of the jaw and the second end of the jaw, further comprising a movable portion slidably coupled to the handle, the movable portion has a feature that cooperates with a feature on the structure to prevent rotation of the handle from a "locked" position to an "unlocked" position.

2. The rail attachment mechanism of claim 1, wherein the cam is coupled to a handle for causing rotation of the cam from a first position in which the jaw is spaced from the surface of the rail and a second position in which the jaw is in contact with the surface of the rail.

3. The rail attachment mechanism of claim 2, wherein the handle is rotatable in a plane perpendicular to the first axis of rotation.

4. The rail attachment mechanism of claim 1, wherein the structure has a cross member for resisting movement of the structure along a longitudinal axis of a weapon during firing of the weapon.

5. The rail attachment mechanism of claim 4, wherein the cross member is an elongated bar.

6. The rail attachment mechanism of claim 4, wherein the cross member is movable in a direction perpendicular to the first axis.

7. The rail attachment mechanism of claim 1, wherein the jaw is a stamped metal piece having a generally uniform thickness.

8. The rail attachment mechanism of claim 7, wherein the jaw is spring steel.

9. The rail attachment mechanism of claim 1, wherein the structure has one or more alignment pins that cooperate with one or more openings in an auxiliary device.

10. The rail attachment mechanism of claim 1, wherein the mounting structure has an elongated member that is parallel with the cam, the elongated member cooperates with a portion of the rail to secure the mounting mechanism to the rail.

11. A rail attachment mechanism for securing an auxiliary device to a rail of a weapon, comprising:

a mounting structure;

a cam secured to the structure and rotatable about a first axis of rotation; and a jaw rotatable about a pin secured to the structure, the pin having a second axis parallel to the first axis, the cam being in contact with a first end of the jaw and rotation of the cam causing a second end of the jaw to come into contact with a surface of a rail of a weapon to squeeze the rail in a direction perpendicular to the first axis of rotation of the cam, the pin being disposed between the first end of the jaw and the second end of the jaw, wherein the jaw is a stamped metal piece having a generally uniform thickness and wherein the jaw is spring steel.

12. A rail attachment mechanism for securing an auxiliary device to a rail of a weapon, comprising:

a mounting structure;

a cam secured to the structure and rotatable about a first axis of rotation; and a jaw rotatable about a pin secured to the structure, the pin having a second axis parallel to the first axis, the cam being in contact with a first end of the jaw and rotation of the cam causing a second end of the jaw to come into contact with a surface of a rail of a weapon to squeeze the rail in a direction perpendicular to the first axis of rotation of the cam, the pin being disposed between the first end of the jaw and the second end of the jaw, wherein the structure has one or more alignment pins that cooperate with one or more openings in an auxiliary device.

* * * * *